US006482470B1

(12) United States Patent
Reeves et al.

(10) Patent No.: US 6,482,470 B1
(45) Date of Patent: Nov. 19, 2002

(54) DIFFUSION ALUMINIDE COATED METALLIC SUBSTRATE INCLUDING A THIN DIFFUSION PORTION OF CONTROLLED THICKNESS

(75) Inventors: Jim Dean Reeves, Cincinnati, OH (US); Nripendra Nath Das, West Chester, OH (US)

(73) Assignee: General Electric Company, Schenectady, NY (US)

( * ) Notice: Subject to any disclaimer, the term of this patent is extended or adjusted under 35 U.S.C. 154(b) by 212 days.

(21) Appl. No.: 09/618,378

(22) Filed: Jul. 18, 2000

(51) Int. Cl.[7] ..... C23C 16/12
(52) U.S. Cl. ..... 427/253; 427/255.26
(58) Field of Search ..... 427/253, 255.26

(56) References Cited

U.S. PATENT DOCUMENTS 3,540,878 A 11/1970 Levine et al. ..... 75/0.5
3,544,348 A 12/1970 Boone et al. ..... 117/2
3,598,638 A 8/1971 Levine ..... 117/107.2 P
3,667,985 A 6/1972 Levine et al. ..... 117/22
4,004,047 A * 1/1977 Grisik ..... 29/402.18
6,036,995 A 3/2000 Kircher et al. ..... 427/142
6,045,863 A 4/2000 Olson et al. ..... 427/253
6,146,696 A * 11/2000 Das et al. ..... 427/253

* cited by examiner

*Primary Examiner*—Timothy Meeks
(74) *Attorney, Agent, or Firm*—David L. Narciso; Lee H. Sachs

(57) ABSTRACT

A method for applying, in a non-oxidizing atmosphere, a diffusion aluminide coating to a metallic surface of an article combines use of a relatively low aluminide coating temperature in the range of about 1650–1800° F. with a relatively high Al activity Al source material including Al of at least about 40 weight %. Such combination results in an as-deposited aluminide coating comprising a diffusion portion bonded between a metallic substrate and a coating outer portion of a thickness of no greater than about 60% of the thickness of the coating outer portion, typically less than about 1 mil.

5 Claims, 6 Drawing Sheets

DIFFUSION ALUMINIDE COATED METALLIC SUBSTRATE INCLUDING A THIN DIFFUSION PORTION OF CONTROLLED THICKNESS

BACKGROUND OF THE INVENTION

This invention relates to an article coated with an environmentally resistant coating and to a method for making such an article. More particularly, it relates to articles made of a high temperature alloy including a protective coating including Al.

It has been a practice in apparatus for use in power generation, for example gas turbine engines, to provide certain components designed to operate at elevated temperatures in an oxidizing atmosphere with environmental resistant or protective coatings. Such coatings are intended to resist attack on the article substrate alloy, during service operation, by such a strenuous atmosphere and/or its contaminants. For example, turbine engine components designed for use in an engine portion within or downstream of a combustion section and made of a high temperature superalloy have been provided with an environmental resistant coating that includes the element Al. Reported forms of such coatings include diffusion aluminide coatings the method of application of which includes processing using Al in slurry, in a vapor, or carried by an ion, for example a halide ion carrier. The method is conducted at an elevated temperature sufficient to enable significant interdiffusion of an outer layer including Al with the substrate. As has been widely describe in the art, the result of such significant interdiffusion is a diffusion portion or zone, between the outer or additive layer or zone and the substrate, of a thickness generally about the same as that of the additive layer.

Certain components, for example gas turbine engine turbine blades, vanes and struts, are designed to operate at a temperature greater than that at which desired mechanical properties of the substrate or structural alloy can be maintained. Therefore, it has been a practice to cool such articles with a fluid such as air flowing within and/or about the article. Forms of fluid or air-cooled gas turbine engine airfoils are described in such U.S. Pat. Nos. as 5,458,461 and 5,503,527—Lee et al. (patented, respectively, on Oct. 17, 1995 and Apr. 2, 1996).

When an environmental resistant diffusion aluminide coating is applied, according to current practice, to an outer wall of such an air-cooled airfoil, the relatively thick diffusion zone involves or becomes part of a portion of the outer wall. In some instances during service operation of such an article, degradation of the environmental resistant diffusion aluminide has been observed and repair is required before the article can be returned to service. Some repair methods comprise removal of the entire coating, including the outer or additive portion as well as the diffusion zone, prior to or in preparation of application of a repair coating. Removal of the coating diffusion zone, that has involved a part of the wall, necessarily results in significant reduction in the article wall thickness, and the consequent reduction in the further repair capability of a re-coated article.

BRIEF SUMMARY OF THE INVENTION

The present invention, in one form, provides a method for applying to an article substrate an aluminide coating which develops, as-deposited, a relatively thin diffusion zone between an article substrate and a coating outer portion, sometimes called the additive zone. For example, in one form, the as-deposited diffusion zone is of a thickness of less than about 1 mil or no greater than about 60% of the coating outer portion or additive zone, as measured by chemical analysis of the coated article. This method minimizes involvement of a wall of the article. The aluminiding method combines the use of a relatively low aluminiding temperature below that at which significant interdiffusion occurs between an outer layer including Al and the substrate, with the use of a relatively high Al activity Al source material. In one example, the combination includes an aluminiding temperature in the range of about 1650–1800° F. and a source material including Al at least at about 40 wt. %.

One embodiment of the article of the present invention includes a metallic substrate, for example a high temperature superalloy, and an aluminide additive or outer portion bonded with the substrate through a diffusion zone, between the outer portion and the substrate, of an as-deposited thickness of less than about 1 mil or no greater than about 60% of the outer portion or additive zone.

DETAILED DESCRIPTION OF THE INVENTION

Airfoils of gas turbine engine turbine components typically are made of a high temperature superalloy based on at least one of Fe, Co and Ni. For example, commercially available Ni base superalloys used for such articles include Rene' 80 alloy, Rene' 142 alloy and Rene' N5 alloy. Commercially available Co base alloys used in gas turbine engines include X-40 alloy.

One commonly used type of environmental resistant, protective diffusion aluminide coating is commercially available as Codep aluminide coating, generally described in Levine et al. U.S. Pat. Nos. 3,540,878; 3,598,638; and 3,667,985. However, aluminide coatings have been applied by a variety of reported methods, herein called aluminiding methods as distinguished from aluminizing methods in which a molten metal is applied to an article surface. In the art, forms of such aluminiding methods sometimes are identified as pack cementation, above the pack, vapor phase, chemical vapor deposition, and slurry coating aluminiding methods.

Generally, known diffusion aluminiding coating methods are conducted in the temperature range of about 1850–2000° F., typically about 1925–1975° F., using a relatively low Al source material, for example including Al in the range of about 25–35 wt. %. These known methods generate at the substrate, concurrently with deposition of Al in an outer portion, a relatively thick diffusion zone, generally of about the thickness of the outer portion and involving a significant portion of the substrate, as discussed above. Such a prior art coating is shown in the diagrammatic, fragmentary sectional view of FIG. 1.

Figure 1:
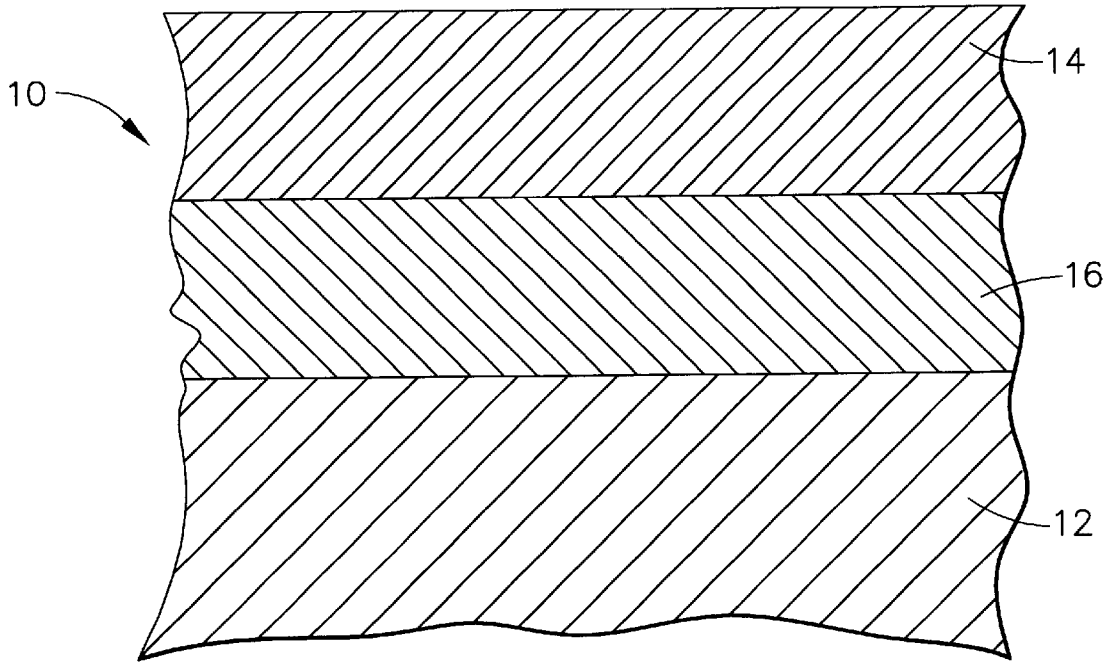
FIG. 1 (PRIOR ART)
FIG. 1 is a diagrammatic, fragmentary sectional view of a metallic wall of an article including a prior art type of diffusion aluminide coating.

In FIG. 1, an article wall, for example made of a high temperature Ni base superalloy, is coated by a known method with a diffusion aluminide coating shown generally at 10 on substrate 12. Coating 10 includes an outer portion or additive zone 14 and a diffusion portion or zone 16 bonding outer portion 14 to substrate 12. As is shown and as is typical of current results, the thickness of the outer portion 14 and diffusion zone 16 generally are about the same. The diffusion zone 16 has been generated from significant interdiffusion between the outer portion 14 and the wall during coating deposition at a relatively high temperature, for example of at least about 1850° F., and generally in the range of about 1925–1975° F. The original wall thickness of the article is represented in FIG. 1 by the sum of the thickness of substrate 12 and thickness of diffusion zone 16.

Figure 2:
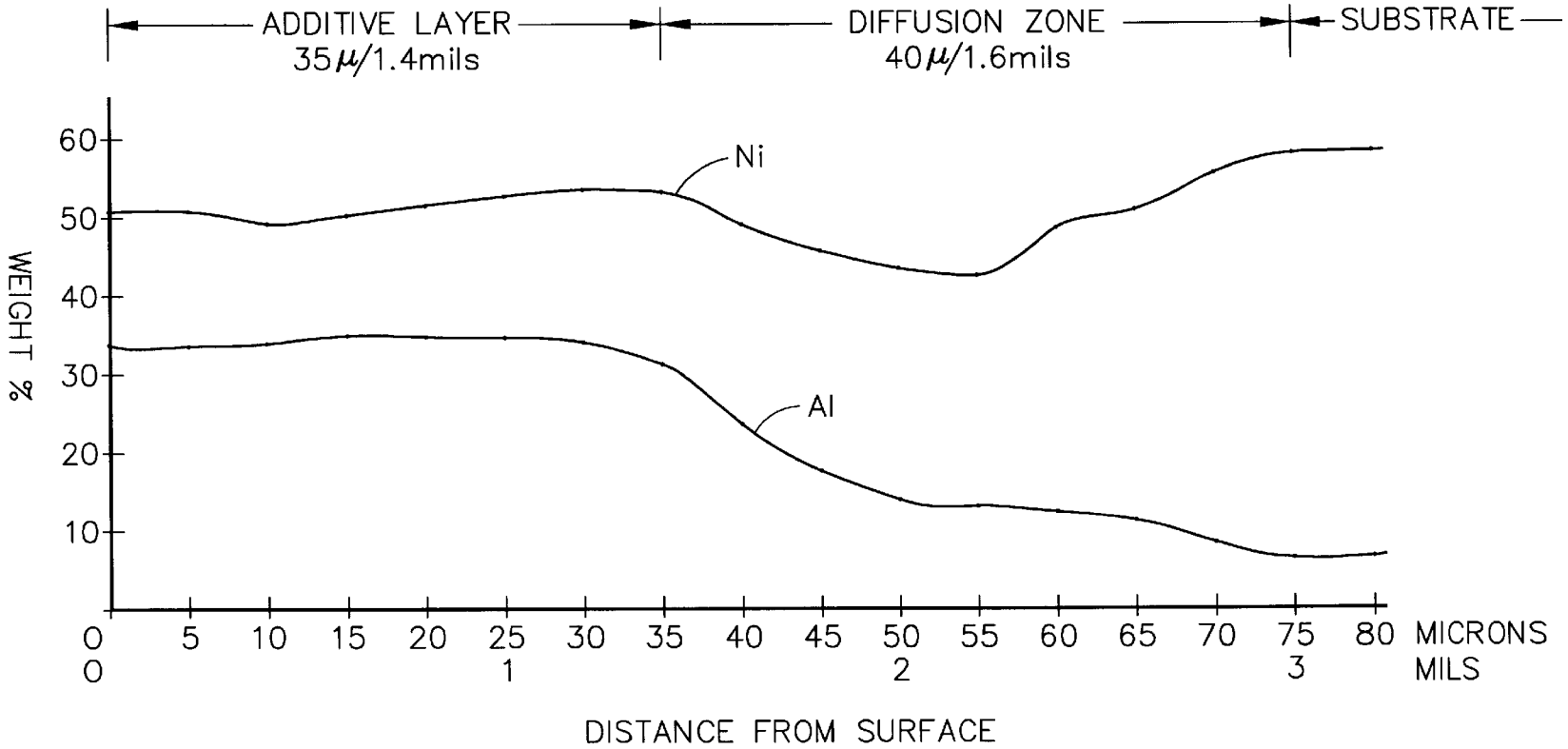
FIG. 2 (PRIOR ART)
FIGS. 2 and 3 each are graphical comparisons of the weight % of Al and Ni at various distances from a coating surface in an aluminide coating of the prior art type shown in FIG. 1, applied by known methods to two different Ni base superalloy substrates.
Figure 3:
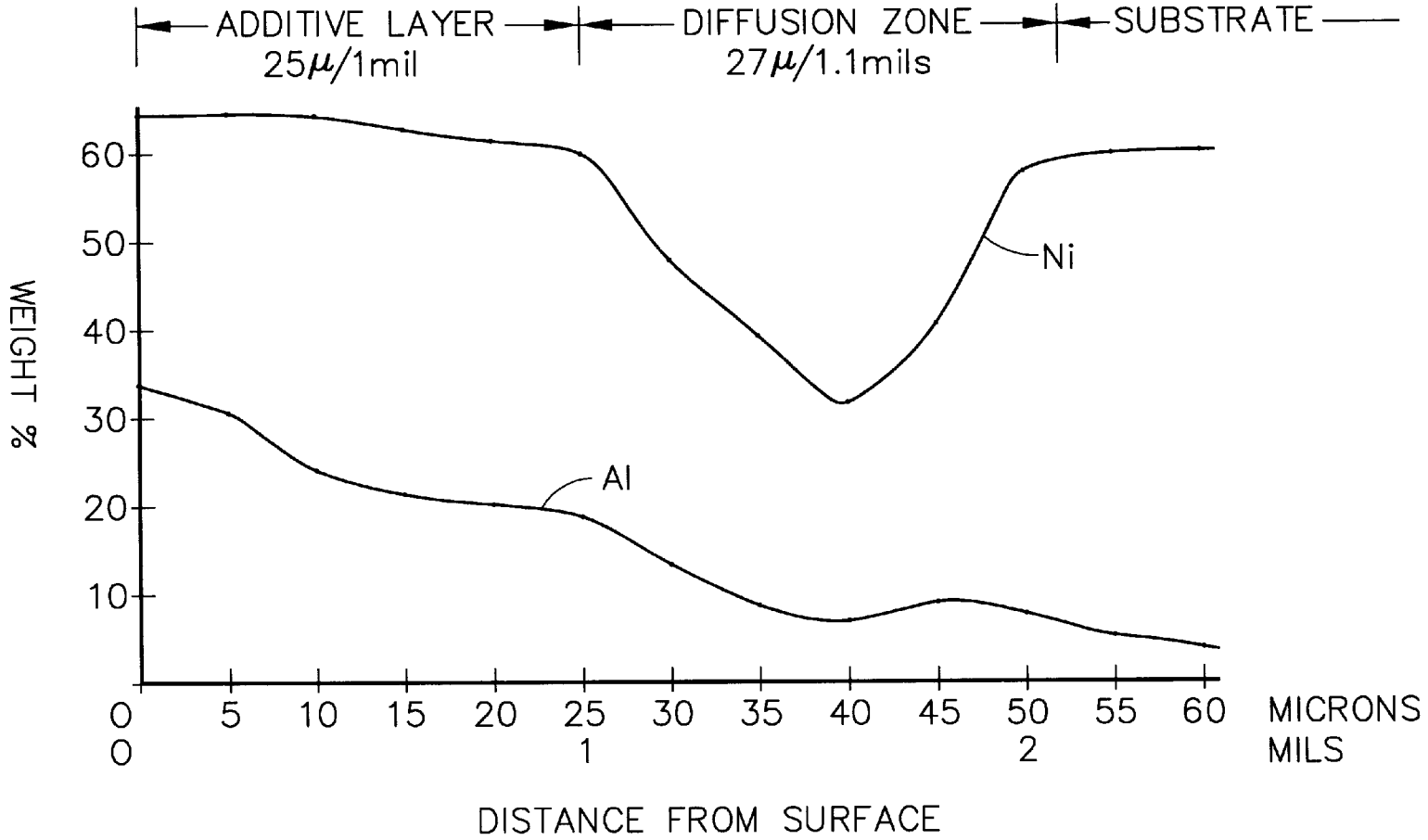
FIG. 3 (PRIOR ART)

The graphical presentations of FIGS. 2 and 3 compare the Al and Ni weight % at various distances from the coating surface to the substrate in two actual known, prior art aluminide coatings applied by two different known methods to two different Ni base superalloys. The data represented in FIGS. 2 and 3 are the results of microprobe chemical analyses of as-deposited coatings traversing a section of the coated substrate. They show the thickness of the coating outer portion and of the diffusion zone as measured by such element content. The amounts (not shown) of minor elements in the coating support those thicknesses.

The data shown in FIG. 2 is from the microprobe chemical analysis of a prior art commercial Codep aluminide coating applied by the known pack cementation type of method to a Rene' 142 Ni base superalloy substrate. The nominal composition of that substrate, in weight %, was about 12 Co, 6 Al, 6.8 Cr, 6.4 Ta, 5 W, 1.5 Mo, 2.8 Re, 1.5 Hf, 0.12 C, 0.015 B, with the balance essentially Ni and incidental impurities. The known method was conducted at a temperature in the range of about 1925–1975° F. for about 5 hours using the commercially available Al source material identified above in connection with Codep aluminiding coating. That source material had an Al content of about 33 wt % within the commonly used range of about 25–35 weight %. This method used fluoride ions from aluminum fluoride to carry Al from the source compound and deposit Al on the substrate in the manner widely used and described in the art.

With reference to FIG. 2, it can be seen that the Al and Ni content in the as-deposited, prior art coating for a distance of about 35 microns (1.4 mils) from the coating surface toward the substrate remained substantially the same. This represents the thickness of the coating outer or additive portion, primarily NiAl. Thereafter, the content of those elements changed, with the Al decreasing and the Ni increasing, as shown, for a distance of about 40 microns (1.6 mils) toward the substrate. That distance represents the thickness of the as-deposited diffusion zone. At about 75 microns (3 mils) from the surface, the Ni and Al content generally were constant and substantially at the content of the substrate Rene' 142 Ni base superalloy. From these data typical of a known, prior art aluminide coating deposited at a temperature of at least about 1850° F., it can be seen that the as-deposited diffusion zone was of about the same thickness as, and in this example greater than, the coating outer portion.

Another example of a similar microprobe chemical analysis of an aluminide coating applied by a known, prior art method at a temperature of at least about 1850° F. is shown in the graphical presentation of FIG. 3. The aluminide coating was applied by commercial vapor phase aluminiding at about 1975° F. for about 6 hours, using CrAl as an Al source material at an Al content of about 30 wt. %. Aluminum fluoride was used as a halide activator. In the example of FIG. 3, the substrate was a Ni base superalloy commercially available as Rene' 80 alloy, and having a nominal composition, in weight %, of about 9.5 Co, 3 Al, 14 Cr, 5 Ti, 4 W, 4 Mo, 0.17 C, 0.015 B, 0.03 Zr, with the balance essentially Ni and incidental impurities.

With reference to the data of FIG. 3, an evaluation of the Al and Ni content of the as-deposited, prior art coating from the coating surface toward the substrate was made as described in connection with FIG. 2. Those data show that in the example of FIG. 3, the coating outer portion extended to a thickness of about 25 microns (1 mil), and the diffusion zone had a thickness of about 27 microns (1.1 mils) until the substrate was reached at about 52 microns (2.1 mils) from the coating surface. Again, it is seen that the thickness of the coating outer portion and of the diffusion zone were about the same. This is typical of the results using known, prior art aluminiding methods at temperatures of at least about 1850° F.

As was mentioned above, when degradation of coating 10 in FIG. 1 occurs as a result of service operation and coating repair is required, it has been a practice, in preparation for application of a repair coating, to remove the entire original coating 10, including removal of outer portion 14 and diffusion zone 16. When such an operation is conducted, it can be seen from the data of FIGS. 2 and 3 that the wall thickness substantially is reduced, for example by the thickness of diffusion zone 16. Such reduction in wall thickness can limit the subsequent repair capability, for example in a subsequent repair in which a diffusion aluminide repair coating must be removed, thereby further reducing the wall thickness to an amount less than that allowed by design limits.

Figure 4:
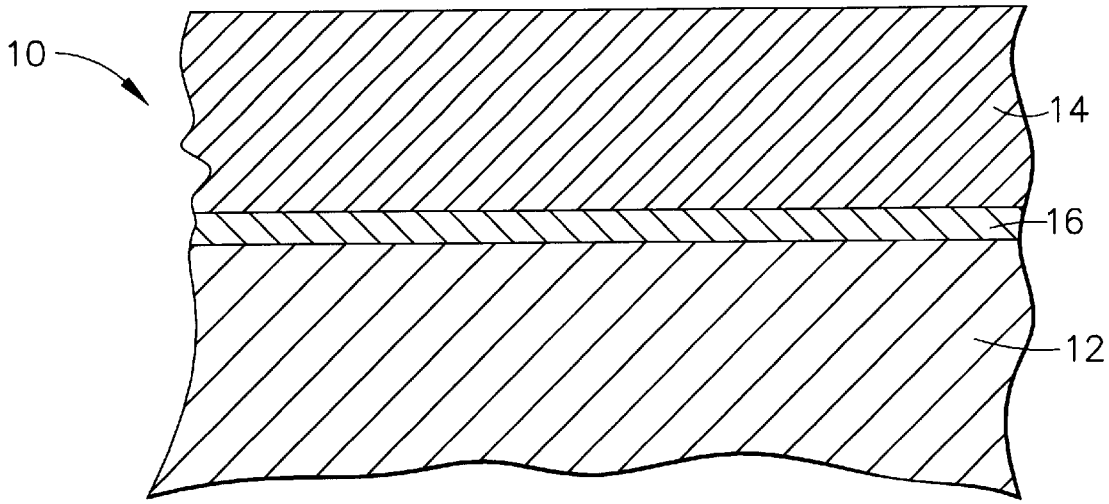
FIG. 4 is a diagrammatic, fragmentary sectional view of a metallic wall including one form of the aluminide coating of the present invention.

A form of the present invention provides a method for substantially limiting and reducing the thickness of an as-deposited diffusion zone in a diffusion aluminide type coating. The method combines the use of a relatively low coating temperature with use of an Al source material relatively high in Al. The diagrammatic, fragmentary sectional view of FIG. 4 shows a wall of an article including one embodiment of the aluminide coating of the present invention, applied in accordance with one form of the method of the present invention. Aluminide coating shown generally at 10 on alloy substrate 12 includes coating outer portion or additive zone 14 and coating diffusion zone 16. Diffusion zone 16 is relatively thin in comparison with the thickness of outer portion 14, generally being less than about 1 mil in thickness or no greater than about 60% of the thickness of outer portion 14.

Figure 5:
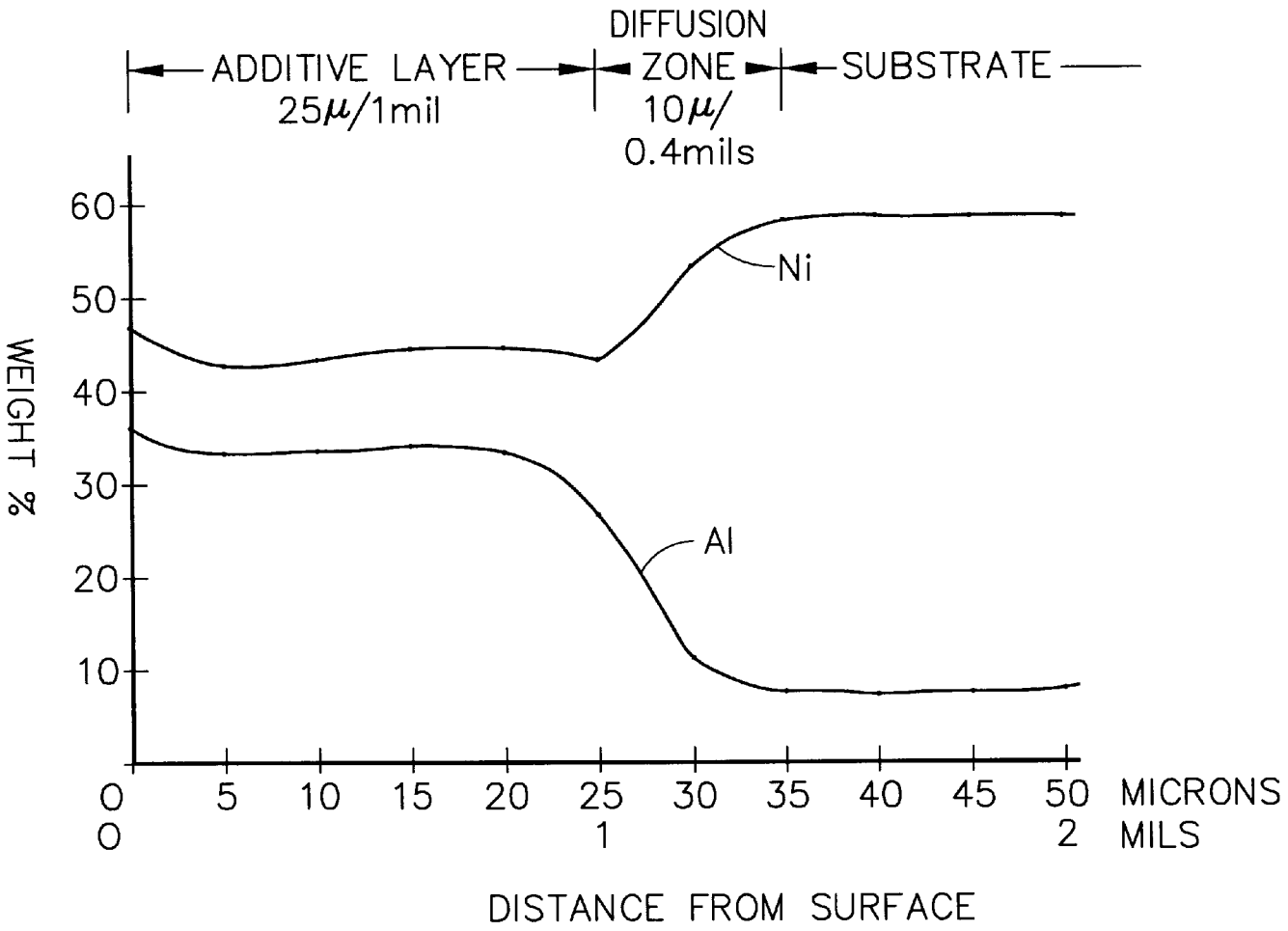
FIGS. 5, 6 and 7 each are graphical comparisons of the weight % of Al and Ni at various distances from a coating surface in an aluminide coating of forms of the present invention, applied to three different Ni base superalloys.
Figure 6:
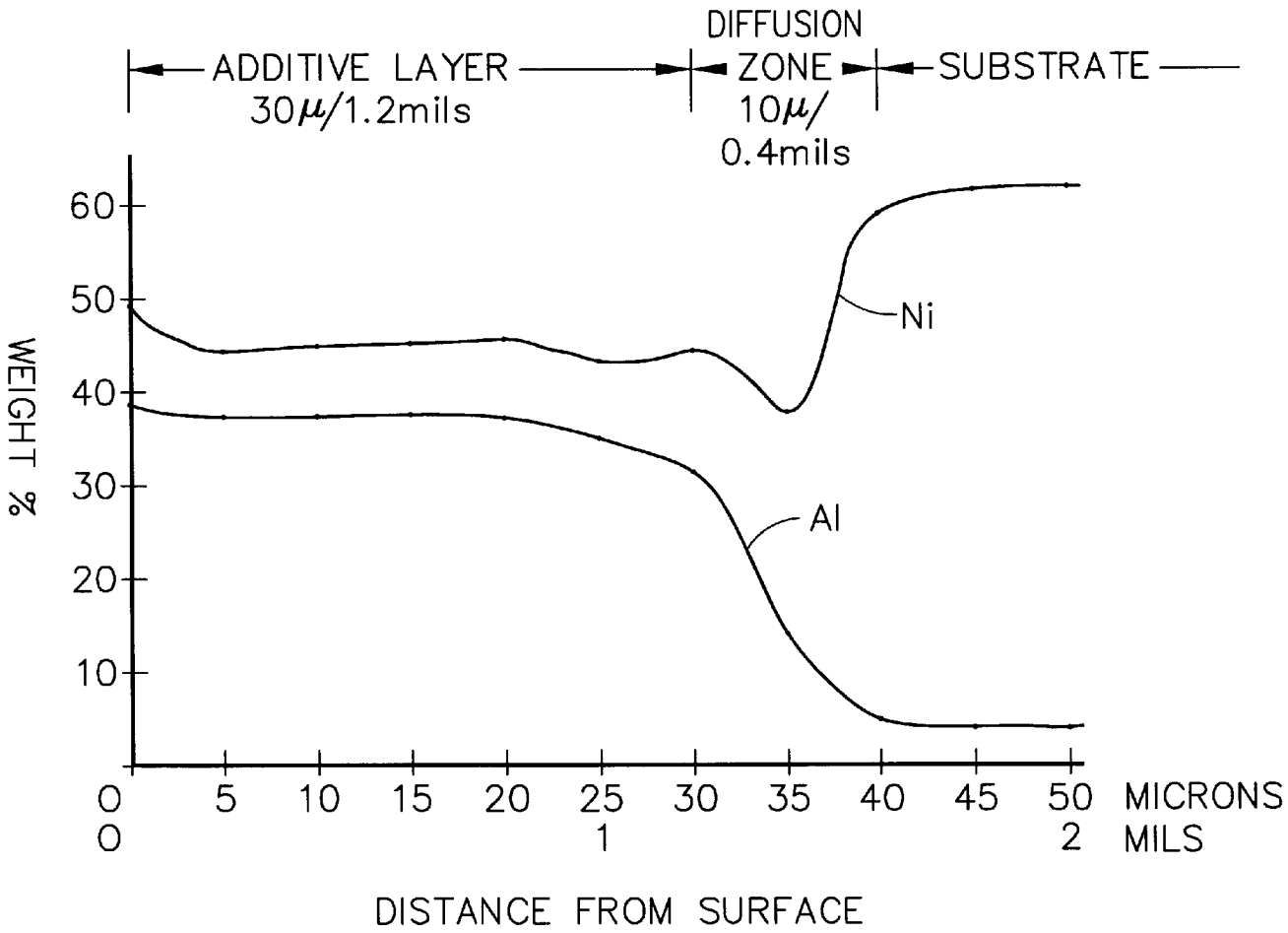
Figure 7:
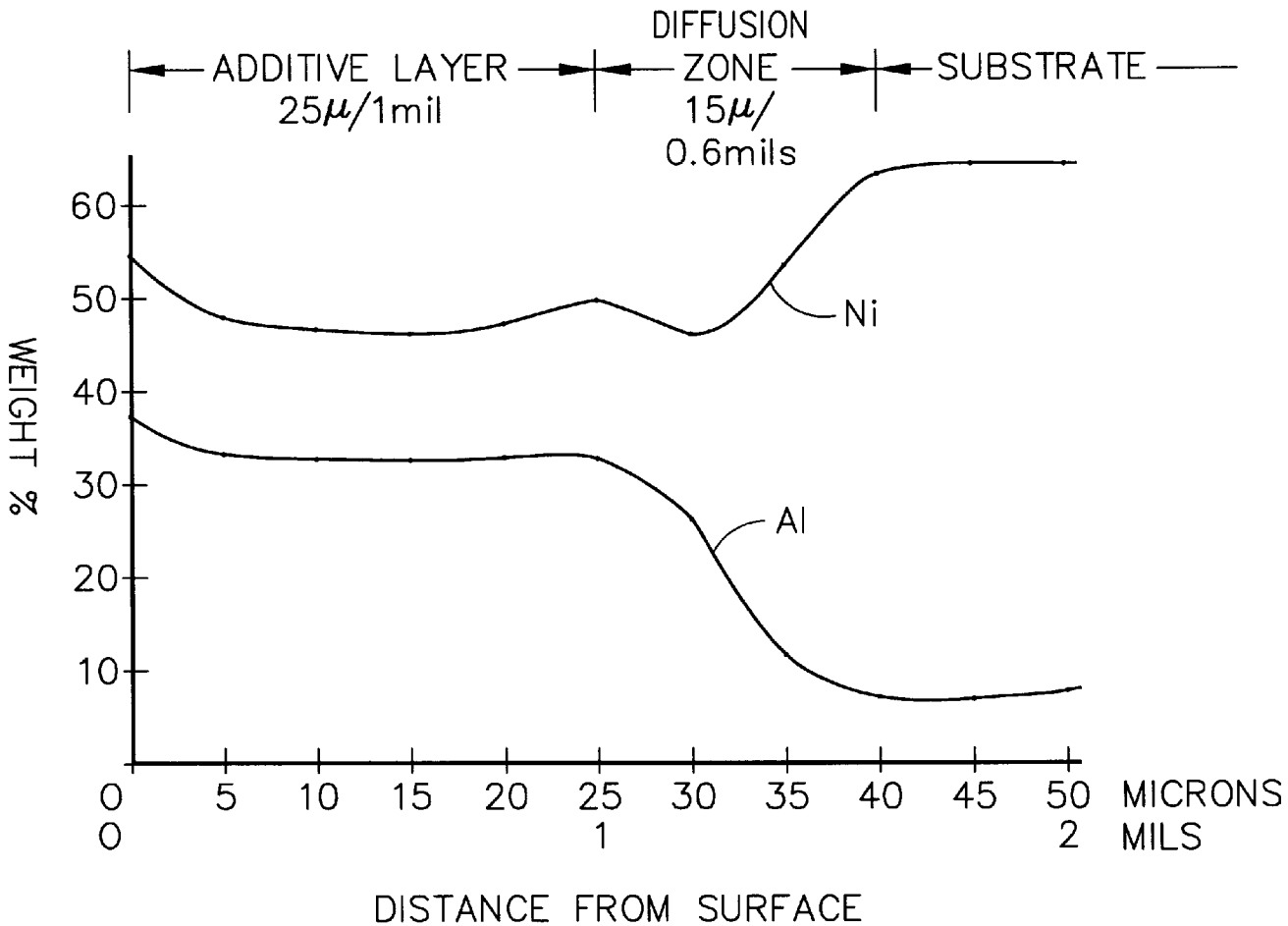

The data in the graphical presentations of FIGS. 5, 6 and 7, generated from microprobe chemical analysis of forms of the present invention, are presented for comparison with the data of FIGS. 2 and 3 for the prior art coatings. The aluminiding method used in connection with FIGS. 5, 6 and 7 was the above-described vapor phase aluminiding method conducted in the lower temperature range of about 1650–1800° F., in this example at about 1700° F. for about 8 hours. The relatively high Al source material, at an Al content of about 50–60 wt. %, within the range of at least about 40 wt. %, was $Co_2Al_5$. A halide activator in the form of $AlF_3$ was used as a source of fluoride ion.

In FIG. 5, the substrate was the above-described Rene' 142 Ni base superalloy. As can be seen from the data of FIG.

5 for the coating as-deposited, the outer portion extended from the coating outer surface to a thickness of at least about 25 microns (1 mil). The diffusion zone had a thickness of about 10 microns (0.4 mils), extending from about 25 to about 35 microns from the surface, until the substrate was reached at about 35 microns. In this example of a form of the present invention, the thickness of the as-deposited diffusion zone was significantly less than that of the coating outer portion, at about 40% of the thickness of the outer portion.

Comparison of the data of FIG. 5 with that of FIG. 2, for the same substrate alloy, or that of FIG. 3, for a vapor phase type method, shows that practice of the present invention results in a significantly thinner diffusion zone for an aluminide diffusion type coating. Viewed from a photomicrograph of a cross section of the coating of the present invention, the diffusion zone generally appears to be almost non-existent, although a small diffusion zone exists as measured by microprobe chemical analysis. The thickness of the known diffusion zone in FIG. 2 was about 114% of the coating outer portion and in FIG. 3 was about 109% of the coating outer portion. Therefore, practice of a form of the method of the present invention provides an as-deposited diffusion zone in a diffusion aluminide type coating that involves significantly less of an article substrate or wall so as to preserve subsequent repair capability of the article.

An example of another form of the present invention is shown in the graphical presentation of FIG. 6. In that example, the substrate was the above-described Rene' 80 Ni base superalloy. As can be seen from the microprobe chemical analysis of the as-deposited coating, the coating outer portion extended from the coating outer surface to a thickness of about 30 microns (1.2 mils). The diffusion zone had a thickness of about 10 microns (0.4 mils), extending from about 30 to about 40 microns from the coating outer surface, until the substrate was reached at about 40 microns. In this example, the diffusion zone resulting from practice of a form of the method of the present invention had a thickness significantly less than that of the coating outer portion, at about 33% of the coating outer portion, as measured by the chemical microprobe analysis of the coated article. This is to be compared with results of practice of known, prior art methods with the diffusion zone generally at a thickness of about 100% or more.

Still another example of a form of the present invention for comparison as above is shown in the graphical presentation of FIG. 7. In that example, the substrate was a Ni base superalloy sometimes called Rene' N5 alloy and having a nominal composition, in wt. %, of about 7 Cr, 6 Al, 5 W, 1.5 Mo, 6.5 Ta, 7.5 Co, 3 Re, 0.15 Hf, 0.01 Y, 0.05 C, 0.004 B, with the balance essentially Ni and incidental impurities. In that example, the coating outer portion of the as-deposited coating, from the microprobe chemical analysis, extended from the coating surface to a thickness of about 25 microns (1 mil). The diffusion zone had a thickness of about 15 microns (0.6 mils), extending from about 25 to about 40 microns from the coating outer surface, until the substrate was reached at about 40 microns. In this example, the diffusion zone resulting from practice of the present invention had a thickness significantly less than that of the coating outer portion, at about 60% of the coating outer portion. The data of FIGS. 5, 6, and 7 represent a preferred form of the present invention in which the as-deposited coating includes a diffusion zone of no greater than about 0.6 mil.

In the method form of the present invention for provision of a diffusion aluminide type of coating, a combination of a relatively low aluminiding temperature and a relatively high Al activity Al source material results in an as-deposited coating diffusion zone significantly smaller than that resulting from practice of known methods. Accordingly, less of the substrate, for example a wall of critical thickness range as discussed above, is involved in the coating, thereby preserving more of the substrate for any subsequent repair in which the aluminide coating is removed. The article form of the present invention includes a diffusion aluminide coating having an as-deposited diffusion zone of less than about 60% of a coating outer portion or less than about 1 mil in thickness.

The present invention has been described in connection with specific examples and embodiments that are intended to be typical of rather than in any way limiting on the scope of the present invention. Those skilled in the arts associated with this invention will understand that it is capable of variations and modifications without departing from the scope of the appended claims.

What is claimed is:

1. In a method for making a coated article including applying a diffusion aluminide coating to a metallic substrate of the article, the coating comprising a coating outer portion of a first thickness and a coating diffusion portion of a second thickness between the coating outer portion and the substrate, the steps of:

providing an Al source material including a total amount of at least about 40 weight % Al; and, conducting a diffusion aluminide coating method in a non-oxidizing atmosphere at a temperature in the range of about 1650° F. to no greater than about 1800° F. for a time sufficient to apply the coating outer portion to the metallic substrate and to control diffusion of the coating outer portion into the substrate to provide the coating diffusion portion to the second thickness at no greater than about 60% of the first thickness and less than about 1 mil in thickness.

2. The method of claim 1 in which:

the metallic substrate is a high temperature alloy based on at least one element selected from the group consisting of Fe, Co and Ni;

the Al in the source material is in the range of about 50–60 weight %; and, the method is conducted in the range of about 1700–1800° F.

3. The method of claim 2 in which the aluminiding is conducted for at least about 3 hours.

4. In the method of claim 2 for applying a diffusion aluminide coating to a surface of a gas turbine engine article in which:

the substrate is a Ni base superalloy;

the source material is an alloy of Al including a total amount of Al in the range of about 50–60 weight %; and, the method is conducted in the range of about 1700–1800° F. for about 3–8 hours.

5. The method of claim 4 in which the substrate is a wall of an airfoil of the article.

* * * * *